US006624793B1

(12) United States Patent
Su et al.

(10) Patent No.: US 6,624,793 B1
(45) Date of Patent: Sep. 23, 2003

(54) DUAL-BAND DIPOLE ANTENNA

(75) Inventors: Chih Ming Su, Taipei (TW); Chi Yin Fang, Pingdong (TW); Tzung Wern Chiou, Taipei (TW); Kin Lu Wong, Kaohsiung (TW)

(73) Assignee: Accton Technology Corporation (TW)

( * ) Notice: Subject to any disclaimer, the term of this patent is extended or adjusted under 35 U.S.C. 154(b) by 0 days.

(21) Appl. No.: 10/140,165

(22) Filed: May 8, 2002

(51) Int. Cl.[7] ..... H01Q 9/16
(52) U.S. Cl. ..... 343/795; 343/793
(58) Field of Search ..... 343/793, 795, 343/801, 806, 812; H01Q 9/16

(56) References Cited

U.S. PATENT DOCUMENTS 3,757,343 A * 9/1973 Bogner ..... 343/770
4,431,998 A * 2/1984 Finken ..... 343/797
5,526,003 A * 6/1996 Ogawa et al. ..... 343/700 MS
5,572,222 A * 11/1996 Mailandt et al. ..... 343/700 MS
5,926,139 A 7/1999 Korisch ..... 343/702
6,008,774 A 12/1999 Wu ..... 343/828
6,172,656 B1 * 1/2001 Ohwada et al. ..... 343/895
6,181,281 B1 * 1/2001 Desclos et al. ..... 343/700 MS
6,333,714 B1 * 12/2001 Takahashi ..... 343/700 MS

* cited by examiner

*Primary Examiner*—Tho Phan

(57) ABSTRACT

A dual-band dipole antenna adapted to be disposed on a dielectric substrate comprises two substantially rectangular radiating metallic sheets and a coaxial transmission line. The substantially rectangular radiating metallic sheets are symmetrically disposed on two sides of the dielectric substrate with respect to the central line thereof, wherein each of the radiating metallic sheets further has a feeding point and a U-shaped slot. One feeding point is disposed opposite to the other feeding point, and the opening of the U-shaped slot is in the direction of the feeding point for dividing the substantially rectangular radiating metallic sheet into a larger sub-metallic sheet and a smaller one, wherein the former serves to generate a first (lower frequency) operating mode of the dual-band dipole antenna, and the latter serves to generate a second (higher frequency) operating mode thereof. The coaxial transmission line has a core conductor and an external ground conductor which are respectively connected to the feeding points.

10 Claims, 3 Drawing Sheets

DUAL-BAND DIPOLE ANTENNA

BACKGROUND OF THE INVENTION

1. Field of the Invention

This present invention generally relates to an antenna, and more particularly to a dual-band dipole antenna for wireless local area network (WLAN) system.

2. Description of the Related Art

The prosperous development of wireless communication industry brings various products and techniques for multi-band communication such that many new products have the performance for wireless communication so as to meet the consumers demand. For example, the inconvenience of wiring and setting owing to the frequent data transmission of a laptop computer is simplified by means of wireless communication devices. Accordingly, the design of an antenna is essential to achieve the purpose for wireless communication. Moreover, if a laptop computer with wireless communication functions desires to be widely accepted and appreciated in the market, the appearance, size, and performance thereof are very critical. Therefore it is relatively essential for a laptop computer to have a well-designed antenna.

Conventional antennas generally adapted to wireless communication products such as laptop computers are substantially grouped into two types, wherein one is the planar inverted F antenna (PIFA) and the other is the monopole antenna. Such two types can generate the operating modes of ¼ wavelength resonance. For example, U.S. Pat. No. 5,926,139 issued to Korisch on Jul. 20, 1999 discloses a planar antenna for use in a radio transceiver device comprising a planar dielectric substrate having first and second surfaces; a first layer on the first surface; a unitary second layer on the second surface having two radiating portion functioning as planar inverted F antennas (PIFA), and a connecting portion joining the radiating portions; a grounding pin; and a feed pin. However, the ground pin must extend through the substrate and interconnect the first layer and the connecting portion of the second layer structurally and thus it is found that the fabrication of the antenna is quite difficult and complicated. In addition, such a planar inverted F antenna typically has a narrow bandwidth such that the usage thereof is disadvantageously restricted. While the monopole antenna has a relatively great bandwidth, a considerably wide ground plane is required for achieving the desired radiation efficiency. Because the space provided by a laptop computer to dispose an antenna is relatively slender, the monopole antenna is also limited in usage.

Furthermore, conventional antennas are merely able to operate in a single band at the most, such as U.S. Pat. No. 6,008,774 issued to Wu on Dec. 28, 1999 entitled "Printed antenna structure for wireless data communication", which discloses a printed antenna including a printed circuit board, a hook-shaped radiating metallic line printed on the top surface of the printed circuit board, a feeding point connected to the hook-shaped radiating metallic line, and a ground plane printed on the bottom surface of the printed circuit board. However, this antenna only operates in the 2.4 GHz band for WLAN operations. Therefore, it is expected that, with the growing market, the performance and market competitiveness of the antenna only operated in a single frequency band will be insufficient. Accordingly, to develop an antenna adapted for dual frequency bands is the mainstream trend of related electronic products.

Accordingly, it is necessary to provide a dual-band dipole antenna, which is able to operate in dual frequency bands (such as 2.4 and 5.2 GHz bands) and has a compact shape particularly adapted to the communication products such as laptop computers so as to achieve the purpose of hiding the antenna and keeping the products ornamental.

SUMMARY OF THE INVENTION

It is a primary object of the present invention to provide a dual-band dipole antenna which is capable of operating in dual frequency bands for WLAN operations.

It is another object of the present invention to provide a dual-band dipole antenna which has a compact shape particularly adapted to the communication products such as laptop computers.

To achieve the aforementioned objects, the present invention provides a dual-band dipole antenna, which is adapted to be disposed on a dielectric substrate and comprises two substantially rectangular radiating metallic sheets and a coaxial transmission line. The substantially rectangular radiating metallic sheets are symmetrically disposed on two sides of a dielectric substrate with respect to the central line thereof, wherein each of the radiating metallic sheets further has a feeding point and a U-shaped slot. One feeding point is disposed opposite to the other feeding point, and the opening of the U-shaped slot is in the direction of the feeding point. The coaxial transmission line has a core conductor and an external ground conductor which are respectively connected to the feeding points.

According to another aspect of the present invention, each of the U-shaped slots serves to divide the corresponding substantially rectangular radiating metallic sheet into a larger sub-metallic sheet and a smaller one, wherein the former serves to generate a first (lower frequency) operating mode of the dual-band dipole antenna and the latter serves to generate a second (higher frequency) operating mode thereof.

According to a further aspect of the present invention, the length of the larger sub-metallic sheet is selected to be approximately ¼ wavelength of a central frequency of the first operating mode and that of the smaller sub-metallic is selected to be approximately ¼ wavelength of a central frequency of the second operating mode.

According to a still further aspect of the present invention, the central frequency of the first operating mode is around 2.4 GHz.

According to a still further aspect of the present invention, the central frequency of the second operating mode is around 5.2 GHz.

BRIEF DESCRIPTION OF THE DRAWINGS

Other objects, advantages, and novel features of the invention will become more apparent from the following detailed description when taken in conjunction with the accompanying drawings.

DETAILED DESCRIPTION OF THE PREFERRED EMBODIMENT

Figure 1:
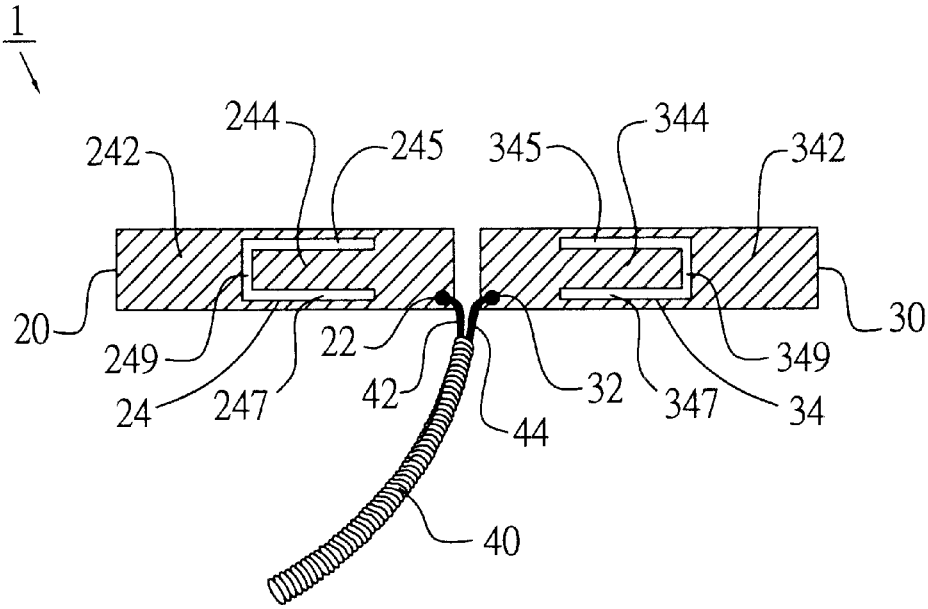
FIG. 1 is a plan view showing a dual-band dipole antenna in accordance with a preferred embodiment of the present invention.

While the present invention is susceptible of embodiments in various forms, the embodiments shown in the drawings and hereinafter described are preferred ones. It is to be understood that the present disclosure is to be considered as an exemplification of the invention and is not intended to limit the invention to the specific embodiments illustrated.

Refer to FIG. 1, which shows a plan view of a dual-band dipole antenna 1 in accordance with a preferred embodiment of the present invention. The dual-band dipole antenna 1 includes two substantially rectangular radiating metallic sheets 20, 30 and a coaxial transmission line 40. The rectangular radiating metallic sheets 20, 30 have corresponding feeding points 22, 32 thereon and U-shaped slots 24, 34. The coaxial transmission line 40 has a core conductor 42 and an external ground conductor 44. The U-shaped slots 24, 34 further comprise corresponding first slits 245, 345, second slits 247, 347 and third slits 249, 349, respectively.

Figure 2:
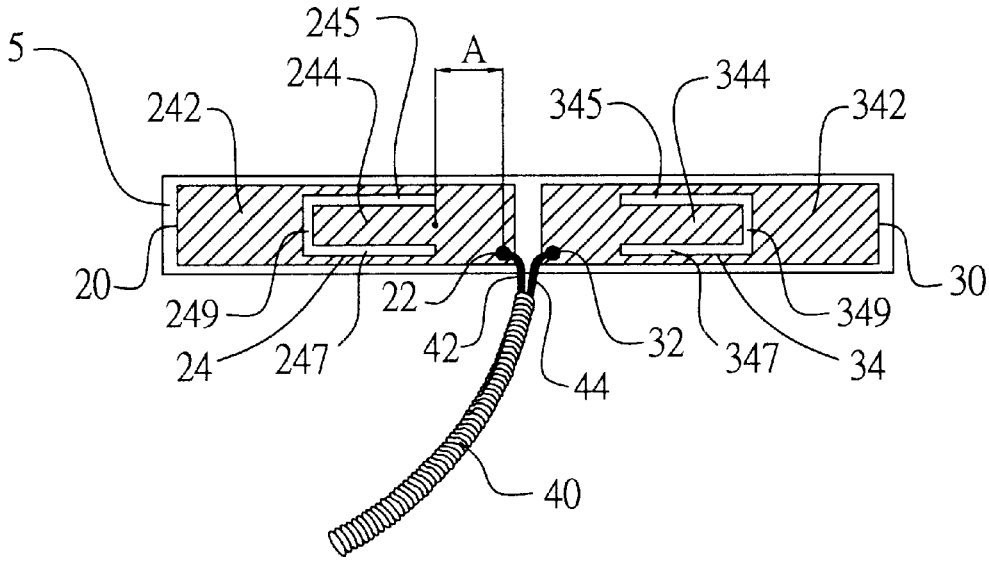
FIG. 2 is a plan view of a dual-band dipole antenna disposed on a dielectric substrate.

FIG. 2 depicts a plan view of the dual-band dipole antenna 1 disposed on a dielectric substrate 5. More particularly, the radiating metallic sheets 20, 30 are respectively and symmetrically positioned on the two opposite sides of the dielectric substrate 5, thereby forming two arms of the antenna 1, and disposed thereon by means of a printing or etching technique. According to the present invention, the dielectric substrate 5 is accomplished in the form of a printed circuit board (PCB) made of BT (bismaleimide-triazine) epoxy or FR4 (fiberglass reinforced epoxy resin), or a flexible film substrate made of polyimide.

The feeding points 22, 32 are respectively disposed on the radiating metallic sheets 20, 30 for transmitting the signals. The U-shaped slots 24, 34 are positioned in a manner that the openings thereof face the feeding points 22, 32 so that the radiating metallic sheets 20, 30 are divided into larger sub-metallic sheets 242, 342 and smaller ones 244, 344 therein, respectively. The larger sub-metallic sheets 242, 342 serve to generate a first (lower frequency) operating mode of the antenna 1 and the smaller ones 244, 344 serve to generate a second (higher frequency) operating mode of the antenna 1, wherein the lengths of the larger sub-metallic sheets 242, 342 are selected to be approximately ¼ wavelength of the central frequency of the first (lower frequency) operating mode, and those of the smaller sub-metallic sheets 244, 344 are selected to be approximately ¼ wavelength of the central frequency of the second (higher frequency) operating mode. The core conductor 42 and external ground conductor 44 are respectively connected to the feeding points 22, 32.

Figure 3:
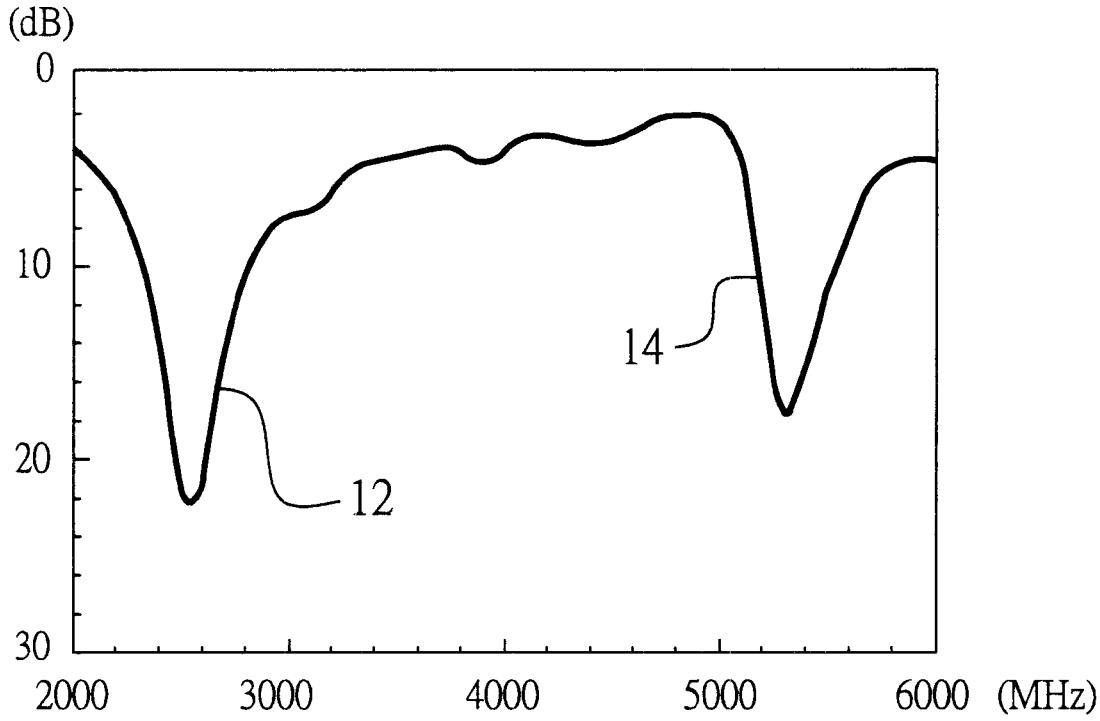
FIG. 3 is the measured return loss of the antenna in FIG. 2.

FIG. 3 depicts the measured return loss of the antenna 1 in FIG. 2. The measured result is obtained under the condition that the dielectric substrate 5 is a fiberglass substrate having a length of 50 mm, a width of 5 mm, and a thickness of 0.4 mm; the both radiating metallic sheets 20, 30 are approximately 23 mm in length and approximately 4 mm in width, and printed on the fiberglass substrate 5; the U-shaped slots 24, 34 are approximately 0.5 mm in width; and the distance from the openings of the U-shaped slots 24, 34 to the corresponding feeding points 22, 32, which is designated at reference character "A", is approximately 5 mm. Accordingly, the central frequency of the first (lower frequency) operating mode 12 is around 2.45 GHz and that of the second (higher frequency) operating mode 14 is around 5.25 GHz. Furthermore, under the definition of the voltage standing wave ratio (VSWR) less than 2, the bandwidths of the first (lower frequency) operating mode 12 and second (higher frequency) operating mode 14 cover the bandwidths of the 2.4 GHz (2.4–2.484 GHz) and 5.2 GHz (5.15–5.35 GHz) bands for WLAN operations. In addition, the antenna 1 of this embodiment is only 5 mm in width and thus is effectively adapted to the laptop computer which only has slender space for accommodating an antenna.

Figure 4A:
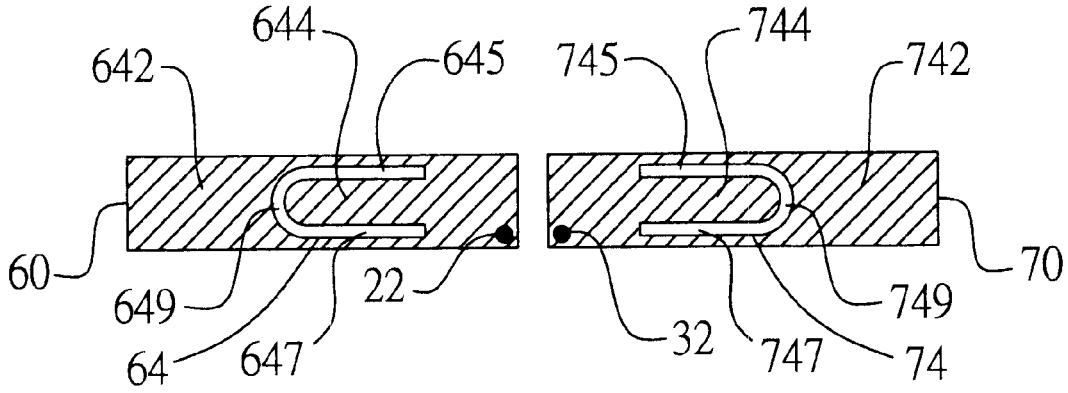
FIG. 4*a* and FIG. 4*b* are the plan views of other embodiments of the radiating metallic sheets of the present invention.
Figure 4B:
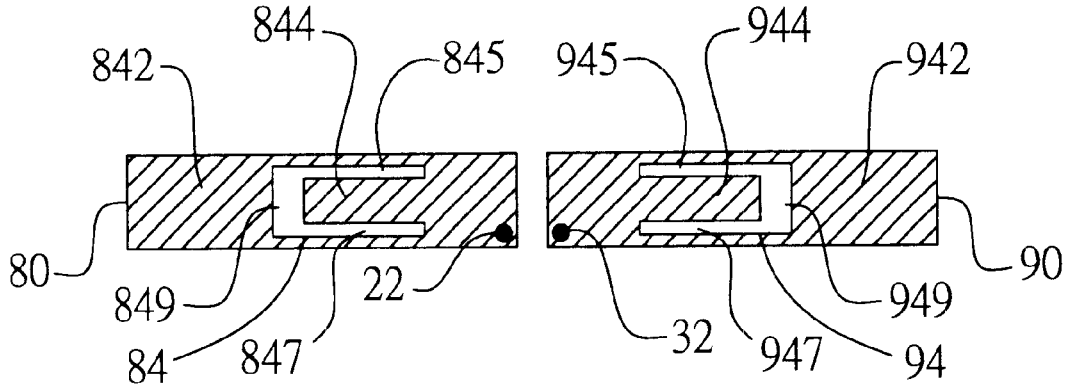

FIG. 4*a* and FIG. 4*b* show the plan views of other embodiments of the radiating metallic sheets 60, 70, 80, and 90 of the present invention. These radiating metallic sheets 60, 70, 80, and 90 are similar to the radiating metallic sheets 20, 30 shown in FIG. 2, and like or corresponding parts are designated with the same reference characters. The U-shaped slots 64, 74, 84, and 94 divide the radiating metallic sheets 60, 70, 80, and 90 into larger sub-metallic sheets 642, 742, 842, and 942 and smaller ones 644, 744, 844, and 944, respectively, wherein the former serve to generate a first (lower frequency) operating mode of the antenna 1 and the latter serve to generate a second (higher frequency) operating mode of the antenna 1. As shown in FIG. 4*a*, the third slits 649, 749 are in the shape of an arc bend, and this arrangement will bring the substantially same performance as that in FIG. 2. Besides, the widths of third slits 849, 949 shown in FIG. 4*b* can be adjusted selectively so that desired central frequencies of the first (lower frequency) and second (higher frequency) operating modes for various applications can be obtained. For example, the widths of third slits 849, 949 can be increased respectively toward the directions of the feeding points 22, 32 to reduce the lengths of the smaller sub-metallic sheets 844, 944 so as to increase the central frequency of the second (higher frequency) operating mode, respectively. Similarly, the arrangement positions of U-shaped slots 24, 34 shown in FIG. 2 are movable longitudinally relative to the radiating metallic sheets 20, 30 so as to simultaneously change both central frequencies of the first (lower frequency) and second (higher frequency) operating modes. Furthermore, the lengths of the radiating metallic sheets 20, 30 can be extended outwardly relative to the U-shaped slots 24, 34 so as to decrease the central frequency of the first (lower frequency) operating mode.

Accordingly, in order to obtain the dual-band operation of the different ratio of the central frequency of the first (lower frequency) operating mode to that of the second (higher frequency) operating mode, modifications of the elements such as the U-shaped slots 24, 34 or radiating metallic sheets 20, 30 shown in FIG. 2 are possible, whereby a dual-band antenna adapted to the 2.4/5.2 GHz dual-band WLAN operation is designed. In addition, both the resonant frequencies (the central frequencies of the first and second operating modes) can have good impedance matching without the need of equipping the antenna 1 of the present invention with additional matching circuits.

While the foregoing description and drawings represent the preferred embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure arrangement, proportions, materials, elements, and components and otherwise, used in the practice of the invention, which are particularly adapted to specific environments and operating requirements without departing from the principles of the present invention. The presently disclosed embodiments are therefore to be considered in all respects as illustrative and not restrictive, the scope of the invention being indicated by the appended claims and their legal equivalents, and not limited to be the foregoing description.

What is claimed is:

1. A dual-band dipole antenna, adapted to be disposed on a dielectric substrate, comprising:

two substantially rectangular radiating metallic sheets, symmetrically disposed on two sides of the dielectric substrate with respect to the central line thereof, thererby forming two arms of the dual-band dipole-antenna, wherein each of the substantially rectangular radiating metallic sheets further has a feeding point disposed opposite to the other feeding point for transmitting signals; and a U-shaped slot of which opening is in the direction of the feeding point for dividing the substantially rectangular radiating metallic sheet into a larger sub-metallic sheet and a smaller one, wherein the former serves to generate a first (lower frequency) operating mode of the dual-band dipole antenna, and the latter serves to generate a second (higher frequency) operating mode thereof; and a coaxial transmission line having a core conductor and an external ground conductor which are respectively connected to the feeding points.

2. The dual-band dipole antenna as claimed in claim 1, wherein the length of each larger sub-metallic sheet is selected to be approximately ¼ wavelength of a central frequency of the first operating mode and that of the smaller sub-metallic sheet is selected to be approximately ¼ wavelength of a central frequency of the second operating mode.

3. The dual-band dipole antenna as claimed in claim 2, wherein the central frequency of the first operating mode is around 2.4 GHz.

4. The dual-band dipole antenna as claimed in claim 2, wherein the central frequency of the second operating mode is around 5.2 GHz.

5. The dual-band dipole antenna as claimed in claim 1, wherein the substantially rectangular radiating metallic sheets are printed on the dielectric substrate.

6. The dual-band dipole antenna as claimed in claim 1, wherein the substantially rectangular radiating metallic sheets are etched on the dielectric substrate.

7. The dual-band dipole antenna as claimed in claim 1, wherein each of the U-shaped slots comprises:

a first slit;

a second slit maintained in a spaced apart relationship with the first slit; and a third slit of which one end connected to one end of the first slit, and other end connected to one end of the second slit, and the other ends of the first and second slits position on the same side of the third slit.

8. The dual-band dipole antenna as claimed in claim 7, wherein each third slit is substantially perpendicular to the first and second slit.

9. The dual-band dipole antenna as claimed in claim 7, wherein each third slit is in the shape of an arc bend.

10. The dual-band dipole antenna as claimed in claim 1, wherein the arrangement position of each U-shaped slot is movable longitudinally relative to the substantially rectangular radiating metallic sheet.

* * * * *